US009905910B2

(12) United States Patent
Chen et al.

(10) Patent No.: US 9,905,910 B2
(45) Date of Patent: Feb. 27, 2018

(54) ELECTRONIC DEVICE AND MULTI-BAND ANTENNA

(71) Applicant: HON HAI PRECISION INDUSTRY CO., LTD., New Taipei (TW)

(72) Inventors: Wei-Yu Chen, New Taipei (TW); Yueh-Chu Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 102 days.

(21) Appl. No.: 14/886,615

(22) Filed: Oct. 19, 2015

(65) Prior Publication Data

US 2017/0047950 A1 Feb. 16, 2017

(30) Foreign Application Priority Data

Aug. 11, 2015 (CN) ..... 2015 1 0488121

(51) Int. Cl.

| | |
|---|---|
| ***H01Q 1/24*** | (2006.01) |
| ***H01Q 9/42*** | (2006.01) |
| ***H01Q 21/28*** | (2006.01) |
| ***H01Q 5/371*** | (2015.01) |

(52) U.S. Cl.

CPC ..... *H01Q 1/243* (2013.01); *H01Q 5/371* (2015.01); *H01Q 9/42* (2013.01); *H01Q 21/28* (2013.01)

(58) Field of Classification Search

None

See application file for complete search history.

(56) References Cited

U.S. PATENT DOCUMENTS

| | | | | |
|---|---|---|---|---|
| 8,742,999 | B2 * | 6/2014 | Amari | H01Q 9/0407 343/700 MS |
| 9,577,332 | B2 * | 2/2017 | Chen | H01Q 1/243 |
| 2009/0284433 | A1 * | 11/2009 | Tsutsumi | H01Q 1/243 343/825 |
| 2014/0057578 | A1 * | 2/2014 | Chan | H04B 1/006 455/77 |
| 2014/0092795 | A1 * | 4/2014 | Granger-Jones | H04L 5/08 370/297 |
| 2015/0009079 | A1 * | 1/2015 | Bojer | H01Q 9/145 343/745 |
| 2015/0084817 | A1 * | 3/2015 | Yong | H01Q 1/243 343/702 |
| 2016/0087343 | A1 * | 3/2016 | Chang | H01Q 1/245 343/720 |

* cited by examiner

*Primary Examiner* — Christopher Grey

(74) *Attorney, Agent, or Firm* — ScienBiziP, P.C.

(57) ABSTRACT

An electronic device with multi-band antenna includes a first antenna frame, a second antenna frame, and a switching unit being electrically coupled between the first antenna frame and the second antenna frame. A first feed point only is located on the first antenna frame and multiple electrical connection points, a second feed point, and a ground point are located on the second antenna frame. One end of the first antenna frame can be connected to one of the electrical connection points by controlling the switching unit, and multiple radiating elements, able to radiate signals in different frequency bands, are formed on the multi-band antenna. Radiating elements are formed between the first feed point and the second feed point and the ground point.

11 Claims, 1 Drawing Sheet

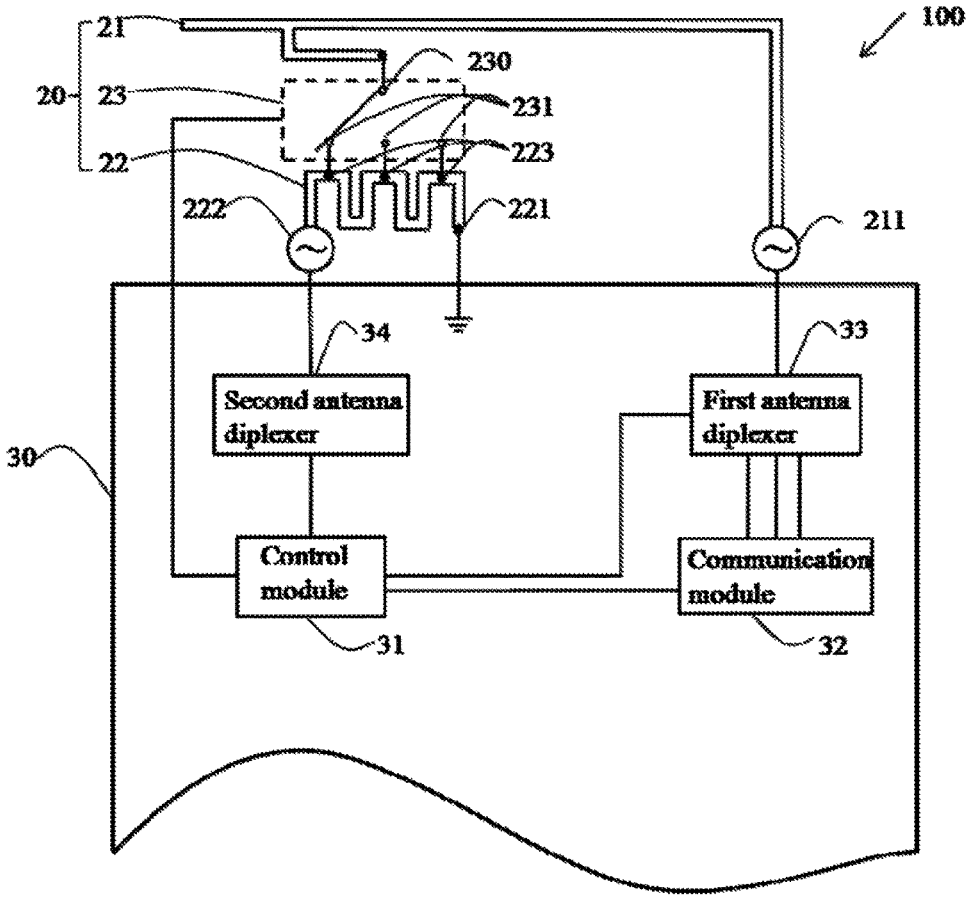
100
21
20
23
22
230
231
223
222
221
211
34
33
Second antenna diplexer
First antenna diplexer
30
Control module
Communication module
31
32

ELECTRONIC DEVICE AND MULTI-BAND ANTENNA

CROSS-REFERENCE TO RELATED APPLICATIONS

This application claims priority to Chinese Patent Application No. 201510488121.X filed on Aug. 11, 2015, the contents of which are incorporated by reference herein.

FIELD

The subject matter herein generally relates to wireless communications.

BACKGROUND

Electronic devices can be equipped with multiple antennas for radiating different signal types. However, multiple antennas occupy a large area of the electronic device, and electromagnetic interference may be generated among the multiple antennas.

BRIEF DESCRIPTION OF THE DRAWING

Implementations of the present disclosure will now be described, by way of example only, with reference to the attached drawing.

The FIGURE shows an embodiment of a multi-band antenna employed in an electronic device.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts can be exaggerated to better illustrate details and features. The present disclosure, including the accompanying drawings, is illustrated by way of examples and not by way of limitation.

Several definitions that apply throughout this disclosure will now be presented.

It should be noted that references to "a/an" or "one" embodiment in this disclosure are not necessarily to the same embodiment, and such references mean "at least one." Furthermore, the term "comprising" means "including, but not necessarily limited to"; it specifically indicates open-ended inclusion or membership in a so-described combination, group, series and the like. The term "coupled" is defined as connected, whether directly or indirectly through intervening components, and is not necessarily limited to physical connections. The connection can be such that the objects are permanently connected or releasably connected.

The FIGURE shows an embodiment of a multi-band antenna 20 employed in an electronic device 100. The electronic device 100 can be a mobile phone, a tablet, or any other suitable electronic device with communication functions. The electronic device 100 further includes a circuit board 30 for the mounting of the multi-band antenna 20.

In at least one embodiment, the multi-band antenna 20 can include, but is not limited to, a first antenna frame 21, a second antenna frame 22, and a switching unit 23. In at least one embodiment, the switching unit 23 is located between the first antenna frame 21 and the second antenna frame 22. In at least one embodiment, the first antenna frame 21 and the second antenna frame 22 each has two end portions. A first feed point 211 is located at one end portion of the first antenna frame 21. A second feed point 222 is located at one end portion of the second antenna frame 22, and a ground point 221 is located at the other end portion of the second antenna frame 22. Multiple electrical connection points 223 are located between the two end portions of the second antenna frame 22.

In at least one embodiment, the switching unit 23 includes multiple connecting terminals. The multiple connecting terminals include a first connecting terminal 230 and multiple second connecting terminals 231. The first connecting terminal 230 can be connected to the other end portion of the first antenna frame 21, and each of the multiple second connecting terminals 231 is connected to one of the multiple electrical connection points 223. When the switching unit 23 is controlled to connect the other end portion of the first antenna frame 21 to one of the multiple electrical connection points 223 of the second antenna frame 22, a pathway is defined between the first feed point 211 of the first antenna frame 21 and the ground point 221 of the second antenna frame 22. In the illustrated embodiment, three electrical connection points 223 are located on the second antenna frame 22, and the switching unit 23 can be a single pole triple throw switch.

In at least one embodiment, the circuit board 30 can include a control module 31, a communication module 32, a first antenna diplexer 33 and a second antenna diplexer 34. The control module 31 is electrically connected to the switching unit 23, and the communication module 32 can send a command to close or open the switching unit 23. The control module 31 can be a central processing unit (CPU), or a microprocessor. If the control module 31 controls the switching unit 23 to close, the other end portion of the first antenna frame 21 can be electrically connected to one of the multiple electrical connection points 223. In at least one embodiment, the communication module 32 can be a 2G/3G/4G communication module. For example, the 2G communication module can be a Global System for Mobile Communications (GSM) module, the 3G communication module can be a Universal Mobile Telecommunications System (UMTS) module, and the 4G communication module can be a Long Term Evolution (LTE) module.

In at least one embodiment, the first antenna diplexer 33 is electronically coupled between the first feed point 211 and the communication module 32. In the illustrated embodiment, the first antenna diplexer 33 can receive different commands from the control module 31, and tune the antenna frequency to a predetermined frequency band.

For example, if the other end portion of the first antenna frame 21 is electrically connected to a first electrical connection point 223 that is farthest away from the ground point 221, a first radiating element formed between the first feed point 211 and the ground point 221 is enabled by the first antenna diplexer 33. The first antenna diplexer 33 can tune the antenna frequency of the first radiating element to a first predetermined frequency band. Thus, the first radiating element can be operated in a first magnetic resonance mode to radiate signals in the first predetermined frequency band. In at least one embodiment, the first predetermined frequency band can be a low frequency band having frequency between 700~960 MHz, a middle frequency band having frequency between 1710~2170 MHz, or a high frequency band having frequency between 1710~2700 MHz.

In one embodiment, if the other end portion of the first antenna frame 21 is electrically connected to a second electrical connection point 223 that is nearest to the ground point 221, a second radiating element formed between the first feed point 211 and the ground point 221 is enabled by the first antenna diplexer 33. The first antenna diplexer 33 can tune the antenna frequency of the second radiating element to a second predetermined frequency band. Thus, the second radiating element can be operated in a second magnetic resonance mode to radiate signals in the second predetermined frequency band. In at least one embodiment, the second predetermined frequency band can be a low frequency band having frequency between 700~960 MHz, a middle frequency band having frequency between 1710~2170 MHz, or a high frequency band having frequency between 1710~2700 MHz.

In at least one embodiment, if the other end portion of the first antenna frame 21 is electrically connected to the remaining one of the multiple electrical connection points 223 (not the first electrical connection point 223 or the second electrical connection point 223), a third radiating element formed between the first feed point 211 and the ground point 221 is enabled by the first antenna diplexer 33. The first antenna diplexer 33 can tune the antenna frequency of the third radiating element to a third predetermined frequency band. Thus, the third radiating element can be operated in a third magnetic resonance mode to radiate signals in the third predetermined frequency band. In at least one embodiment, the third predetermined frequency band can be a low frequency band having frequency between 700~960 MHz, a middle frequency band having frequency between 1710~2170 MHz, or a high frequency band having frequency between 1710~2700 MHz.

In at least one embodiment, the frequencies belonging to the first predetermined frequency band are lower than the frequencies belonging to the second predetermined frequency band. The frequencies belonging to the third predetermined frequency band are higher than those of the first predetermined frequency band, and are lower than those of the second predetermined frequency band.

In at least one embodiment, a first length from the first electrical connection point 223 to the ground point 221 is not more than a first difference value. The first difference value is a distance which is between a quarter of a wavelength of a first predetermined frequency and a length of the first antenna frame 21, the first predetermined frequency belonging to a frequency band that is available for the first radiating element and the first antenna frame 21. A second length from the second electrical connection point 223 to the ground point 221 is a distance not more than a second difference value, the second difference value being a distance which is between a quarter of a wavelength of a second predetermined frequency and a length of the first antenna frame 21, the second predetermined frequency belonging to a frequency band that is available for the second radiating element and the first antenna frame 21. A third length from the remaining one of the multiple electrical connection points 223 to the ground point 221 is not more than a third difference value. The third difference value is a distance which is between a quarter of a wavelength of a third predetermined frequency and a length of the first antenna frame 21, the third predetermined frequency belonging to a frequency band that is available for the third radiating element and the first antenna frame 21.

In at least one embodiment, the second antenna diplexer 34 is electronically coupled between the second feed point 222 and the control module 31. The second antenna diplexer 34 can receive command from the control module 31, and tune the antenna frequency to a fourth predetermined frequency band. Thus, the second antenna frame 22 can be operated on a fourth magnetic resonance mode to radiate signals in the fourth predetermined frequency band. In at least one embodiment, a length of the second antenna frame 22 is not more than a distance equal to a quarter of the wavelength of the frequency belonging to the fourth predetermined frequency band. In at least one embodiment, the fourth predetermined frequency band can be a low frequency band having frequency between 700~960 MHz, a middle frequency band having frequency between 1710~2170 MHz, or a high frequency band having frequency between 1710~2700 MHz.

For example, the first predetermined frequency band can be the low frequency band of the 2G/3G/4G communication system, the second predetermined frequency band can be the middle frequency band of the 2G/3G/4G communication system, and the fourth predetermined frequency band can be the high frequency band of the 2G/3G/4G communication system. Then, the first feed point 211 can be configured to receive and/or transmit middle or low frequencies and the second feed point 222 can be configured to receive and/or transmit high frequencies. Thus, the antenna 20 can provide long-distance transmission of the 2G/3G/4G signals.

In other embodiments, the first predetermined frequency band, the second predetermined frequency band, the third predetermined frequency band, and the fourth predetermined frequency band or any of them can be a Near Field Communication (NFC) frequency band, or a Wireless Power Transmission (WPT) frequency band, or WIFI frequency band, or BLUETOOTH frequency band. Thus, the antenna 20 can provide short-distance transmission of the NFC/WPT/WIFI/BLUETOOTH signals.

The embodiments shown and described above are only examples. Even though numerous characteristics and advantages of the present technology have been set forth in the foregoing description, together with details of the structure and function of the present disclosure, the disclosure is illustrative only, and changes can be made in the detail, including in particular the matters of shape, size, and arrangement of parts within the principles of the present disclosure, up to and including the full extent established by the broad general meaning of the terms used in the claims.

What is claimed is:

1. A multi-band antenna comprising:

a first antenna frame having two end portions;

a first feed point located on the first antenna frame;

a second antenna frame having two end portions;

a plurality of electrical connection points, a second feed point, and a ground point located on the second antenna frame, wherein the plurality of electrical connection points are located between the two end portions of the second antenna frame; and a switching unit electrically coupled between the first antenna frame and the second antenna frame, wherein the switching unit is configured to selectively connect the first antenna frame to one of the electrical connection points of the second antenna frame;

wherein the switching unit comprises multiple connecting terminals, the multiple connecting terminals comprise a first connecting terminal that is connected to one end portion of the first antenna frame, and multiple second connecting terminals that are respectively connected to the multiple electrical connection points; wherein when the switching unit is controlled to connect the first connecting terminal to one of the second connecting terminals, the one end portion of the first antenna frame is electrically connected to corresponding one of the multiple electrical connection points of the second antenna frame;

wherein when the switching unit controls the one end portion of the first antenna frame to connect to a first electrical connection point that is farthest away from the ground point, a first radiating element formed between the first feed point and the ground point is enabled and operated in a first magnetic resonance mode to radiate signals in a first predetermined frequency band;

when the switching unit controls the one end portion of the first antenna frame to connect to a second electrical connection point that is nearest to the ground point, a second radiating element formed between the first feed point and the ground point is enabled and operated in a second magnetic resonance mode to radiate signals in a second predetermined frequency band; and when the switching unit controls the one end portion of the first antenna frame to connect to one of the multiple electrical connection points except the first and the second electrical connection point, a third radiating element formed between the first feed point and the ground point is enabled and operated in a third magnetic resonance mode to radiate signals in a third predetermined frequency band.

2. The multi-band antenna as described in claim 1, wherein a frequency of the first predetermined frequency band is less than the frequency of the second predetermined frequency band, the frequency of the third predetermined frequency band is higher than the frequency of the first predetermined frequency band, but less than the frequency of the second predetermined frequency band.

3. The multi-band antenna as described in claim 1, wherein a first length from the first electrical connection point to the ground point is not more than a first difference value, the first difference value is a distance which is between a quarter of a wavelength of a first predetermined frequency and a length of the first antenna frame, and the first predetermined frequency belonging to a frequency band that is available for the first radiating element and the first antenna frame;

a second length from the second electrical connection point to the ground point is not more than a second difference value, the second difference value is a distance which is between a quarter of a wavelength of a second predetermined frequency and a length of the first antenna frame, and the second predetermined frequency belonging to a frequency band that is available for the second radiating element and the first antenna frame; and a third length from the remaining one of the multiple electrical connection points to the ground point is not more than a third difference value, the third difference value is a distance which is between a quarter of a wavelength of a third predetermined frequency and a length of the first antenna frame, and the third predetermined frequency belonging to a frequency band that is available for the third radiating element and the first antenna frame.

4. The multi-band antenna as described in claim 1, wherein the second antenna frame can be operated on a fourth magnetic resonance mode to radiate signals in a fourth predetermined frequency band.

5. The multi-band antenna as described in claim 4, wherein a length of the second antenna frame is not more than a quarter of a wavelength of the fourth predetermined frequency band.

6. An electronic device comprising:

a control module; and a multi-band antenna comprising:

a first antenna frame having two end portions;

a first feed point located on the first antenna frame;

a second antenna frame having two end portions;

a plurality of electrical connection points, a second feed point, and a ground point located on the second antenna frame, wherein the plurality of electrical connection points are located between the two end portions of the second antenna frame; and a switching unit electrically coupled between the first antenna frame and the second antenna frame, wherein the switching unit is configured to selectively connect the first antenna frame to one of the electrical connection points of the second antenna frame;

a first antenna diplexer, a second antenna diplexer and a communication module, wherein the first antenna diplexer is electronically coupled between the first feed point and the communication module, the second antenna diplexer is electronically coupled between the second feed point and the communication module;

wherein the first antenna diplexer and the second antenna diplexer are configured to receive different commands from the control module, and tune the antenna frequency to predetermined frequency band;

wherein when the switching unit controls the one end portion of the first antenna frame to connect to a first electrical connection point that is farthest away from the ground point, a first radiating element formed between the first feed point and the ground point is enabled and operated in a first magnetic resonance mode to radiate signals in a first predetermined frequency band;

when the switching unit controls the one end portion of the first antenna frame to connect to a second electrical connection point that is nearest to the ground point, a second radiating element formed between the first feed point and the ground point is enabled and operated in a second magnetic resonance mode to radiate signals in a second predetermined frequency band; and when the switching unit controls the one end portion of the first antenna frame to connect to one of the multiple electrical connection points except the first and the second electrical connection point, a third radiating element formed between the first feed point and the ground point is enabled and operated in a third magnetic resonance mode to radiate signals in a third predetermined frequency band.

7. The electronic device as described in claim 6, wherein the switching unit comprises multiple connecting terminals, the multiple connecting terminals comprises a first connecting terminal that is connected to one end portion of the first antenna frame, and multiple second connecting terminals that are respectively connected to the multiple electrical connection points; wherein when the switching unit is controlled to connect the first connecting terminal to one of the second connecting terminals, the one end portion of the first antenna frame is electrically connected to the electrical connection point of the second antenna frame.

8. The electronic device as described in claim 6, wherein a frequency of the first predetermined frequency band is less than the frequency of the second predetermined frequency band, the frequency of the third predetermined frequency band is higher than the frequency of the first predetermined frequency band, and is less than the frequency of the second predetermined frequency band.

9. The electronic device as described in claim 6, wherein a first length from the first electrical connection point to the ground point is not more than a first difference value, the first difference value is a distance which is between a quarter of a wavelength of a first predetermined frequency and a length of the first antenna frame, and the first predetermined frequency belonging to a frequency band that is available for the first radiating element and the first antenna frame;

a second length from the second electrical connection point to the ground point is not more than a second difference value, the second difference value is a distance which is between a quarter of a wavelength of a second predetermined frequency and a length of the first antenna frame, and the second predetermined frequency belonging to a frequency band that is available for the second radiating element and the first antenna frame; and a third length from the remaining one of the multiple electrical connection points to the ground point is not more than a third difference value, the third difference value is a distance which is between a quarter of a wavelength of a third predetermined frequency and a length of the first antenna frame, and the third predetermined frequency belonging to a frequency band that is available for the third radiating element and the first antenna frame.

10. The electronic device as described in claim 6, wherein the second antenna frame can be operated on a fourth magnetic resonance mode to radiate signals in a fourth predetermined frequency band.

11. The electronic device as described in claim 10, wherein a length of the second antenna frame is not more than a quarter of a wavelength of the fourth predetermined frequency band.

* * * * *